United States Patent [19]

Muramatsu et al.

[11] Patent Number: 4,717,316

[45] Date of Patent: Jan. 5, 1988

[54] ROTARY COMPRESSOR

[75] Inventors: Shigeru Muramatsu; Shigeru Shida; Takeo Horie; Masashi Yamada, all of Shizuoka, Japan

[73] Assignee: Mitsubishi Denki Kabushiki Kaisha, Tokyo, Japan

[21] Appl. No.: 43,450

[22] Filed: Apr. 28, 1987

[30] Foreign Application Priority Data

Apr. 28, 1986 [JP] Japan ..... 61-99124

[51] Int. Cl.[4] ..... F04B 35/00; F04B 39/02; F04B 39/06; F01M 1/00

[52] U.S. Cl. ..... 417/372; 417/902; 184/6.16; 418/DIG. 1

[58] Field of Search ..... 417/366, 369, 372, 902; 55/406, 438; 184/6.16, 11.1, 13.1; 418/DIG. 1; 416/202

[56] References Cited

U.S. PATENT DOCUMENTS

| | | | |
|---|---|---|---|
| 1,967,034 | 7/1934 | Lipman | 417/902 |
| 3,169,696 | 2/1965 | Warner | 417/372 |
| 3,176,914 | 4/1965 | Rinehart | 417/372 |
| 3,872,562 | 3/1975 | Pestel | 29/156 R |

FOREIGN PATENT DOCUMENTS

| | | | |
|---|---|---|---|
| 0152195 | 9/1983 | Japan | 418/DIG. 1 |
| 0170893 | 10/1983 | Japan | 418/DIG. 1 |
| 0053691 | 3/1985 | Japan | 418/DIG. 1 |
| 60-90995 | 5/1985 | Japan . | |
| 0145484 | 7/1985 | Japan | 417/366 |

*Primary Examiner*—Carlton R. Croyle
*Assistant Examiner*—Leonard P. Walnoha
*Attorney, Agent, or Firm*—Oblon, Fisher, Spivak, McClelland & Maier

[57] ABSTRACT

In a rotary compressor having a motor element and a compression element contained in a sealing case, an oil separating device for separating lubricating oil from an oil-containing refrigerant is attached on the rotor of the motor element. The oil separating device has a circular plate having a diameter substantially equal to the outer diameter of the rotor, wherein a channel-like recess projecting toward the rotor is formed in the circular plate at a position deviated from its central portion; the lower surface of the channel-like recess is adapted to be firmly connected to the upper surface of the rotor, and an aperture is formed at the central portion so that the discharge tube is loosely inserted in the aperture.

4 Claims, 8 Drawing Figures

FIGURE 8 *PRIOR ART*
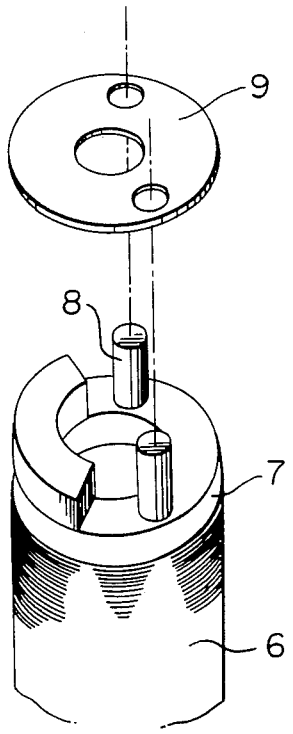

ROTARY COMPRESSOR

The present invention relates to a rotary compressor used for compressing a refrigerant gas for an air conditioner.

FIG. 7 is a longitudinal cross-sectional view of a conventional rotary compressor disclosed, for instance, in Japanese Unexamined Utility Model Publication No. 27167/1984 and FIG. 8 is a exploded perspective view showing an oil separating member used for the conventional rotary compressor.

In FIG. 7, a reference numeral 1 designates a sealing case which contains a motor element 2 at its upper part and a compression element 3 driven by the motor element 2 at its lower part. A discharge tube 4 is vertically extended through the central part of the upper end of the sealing case 1 and is fixed thereto. A lubricating oil 5 such as a refrigerating machine oil is received in the bottom of the sealing case 1. The lubricating oil is to lubricate each sliding part in the compression element 3.

As clearly shown in FIG. 8, a circular plate 9 made of a flat sheet material is fixed to the rotor 6 of the motor element 2. The circular plate 9 is apart from the upper surface of the rotor 6 by means of a pair of caulking pins 8 projecting from an end ring 7. In FIG. 7, a numeral 10 designates an upper space in the sealing case 1, a numeral 11 designates the stator of the motor element 2, a numeral **11*a* designates a coil end of the stator 11, a numeral 11*b* designates slots formed in the stator, a numeral 2*a* designates an air gap between the stator 11 and the rotor 6, and a numeral 4*a* designates an opening formed at the lower end of the discharge tube 4**.

The operation of the conventional rotary compressor will be described with reference to FIG. 7 in which arrow marks indicated by the solid line represents the flow of lubricating oil and arrow marks indicate by the broken line represents the flow of gas such as a refrigerant gas.

When the compression element 3 is driven by the motor element 2, the gas directly sucked into the compression element 3 is discharged in the upper part of the sealing case 1 after it has been compressed. Since the highly compressed gas discharged from the compression element 3 agitates the surface of the lubricating oil 5 contained in the bottom of the sealing case 1, a substantial amount of oil 5 is carried in the upper space 10 of the sealing case 1, i.e. above the motor element 2. In this case, if an oil separating means such as the circular plate 9 is not provided in the upper space of the sealing case 1, the lubricating oil 5 is discharged through the discharge tube 4 from the lower opening **4*a*** together with the highly compressed gas, and the oil is circulated in a refrigeration system.

In the conventional rotary compressor shown in FIG. 7, the lubricating oil is carried with the highly compressed gas into the upper space 10 through the air gap **2*a* of the motor element 2 and the slots 2*b* of the stator. When the lubricating oil is brought to contact with the front and the rear surfaces of the circular plate 9, the centrifugal force is imparted to the lubricating oil because the circular plate 9 is rotated with the rotor 6 of the motor element 2, whereby the oil having a specific gravity greater than the gas is splashed in the cricumferential direction of the circular plate 9. The splashed lubricating oil collides with the refrigerant gas containing much lubricating oil which is carried from the lower part of the sealing case 1, whereby the oil is separated from the refrigerant gas. As a result, only the gas reaches the lower opening 4*a* of the discharge tube 4 to be discharged out of the sealing case 1**. Accordingly, there is avoidable reduction in effectiveness of heat exchange in a heat exchanger installed in a refrigerating or air-conditioning apparatus by the deposition of the lubricating oil on the inner wall of tubes of the refrigerating system.

Thus, in the conventional rotary compressor, although a desired effect for separating the lubricating oil can be obtained in the normal operation in which a regulated amount of the refrigerant is contained, by means of the circular plate constituting the oil separating means, when an excessive amount of the refrigerant is used, an amount of the lubricating oil 5 dissolved in the refrigerant increases, and therefore, a sufficient effect for separating the oil can not be obtained. Further, if the height of the coil end **11*a* fitted in the stator 11 of the motor element 2 is large, or the height of the end ring 7 provided on the rotor 6 is small, the lubricating oil subjected to the separation by the centrifugal force is combined with the highly pressurized gas coming up through the air gap 2*a* to reduce the effect of oil separation. As a result, there was found in the conventional rotary compressor that an amount of the lubricating oil in the sealing case 1 was reduced, and the function of the sliding parts in the compression element 3** was lowered.

It is an object of the present invention to provide a rotary compressor which improves effect of separating a lubricating oil from a refrigerant gas to increase reliability of the sliding parts of a compression element; has stable oil separation properties even when an excessive amount of the refrigerant is used and even though a relative distance between the adjacent parts of a motor element is changed, and prevents the lubricating oil from flowing out of the sealing case.

The foregoing and the other objects of the present invention have been attained by providing a rotary compressor comprising a sealing case, a motor element housed in the upper part of the sealing case, a compression element housed in the lower part of the sealing case so as to be driven by the motor element, a discharge tube provided at the top of the sealing case so that compressed gas filled in the upper part of the sealing container is discharged out of the same and an oil separating means mounted-on the rotor of the motor element, characterized in that the oil separating means has a circular plate having a diameter substantially equal to the outer diameter of the rotor, wherein a channel-like recess projecting toward the rotor is formed in the circular plate at a position deviated from its central portion; the lower surface of the channel-like recess is adapted to be firmly connected to the upper surface of the rotor, and an aperture is formed at the central portion so that the discharge tube is loosely inserted in the aperture.

In the drawings;

FIG. 8 is an exploded perspective view showing an oil separating means used for the conventional rotary compressor.

In the following, preferred embodiments of the present invention will be described with reference to the drawings.

Figure 1:
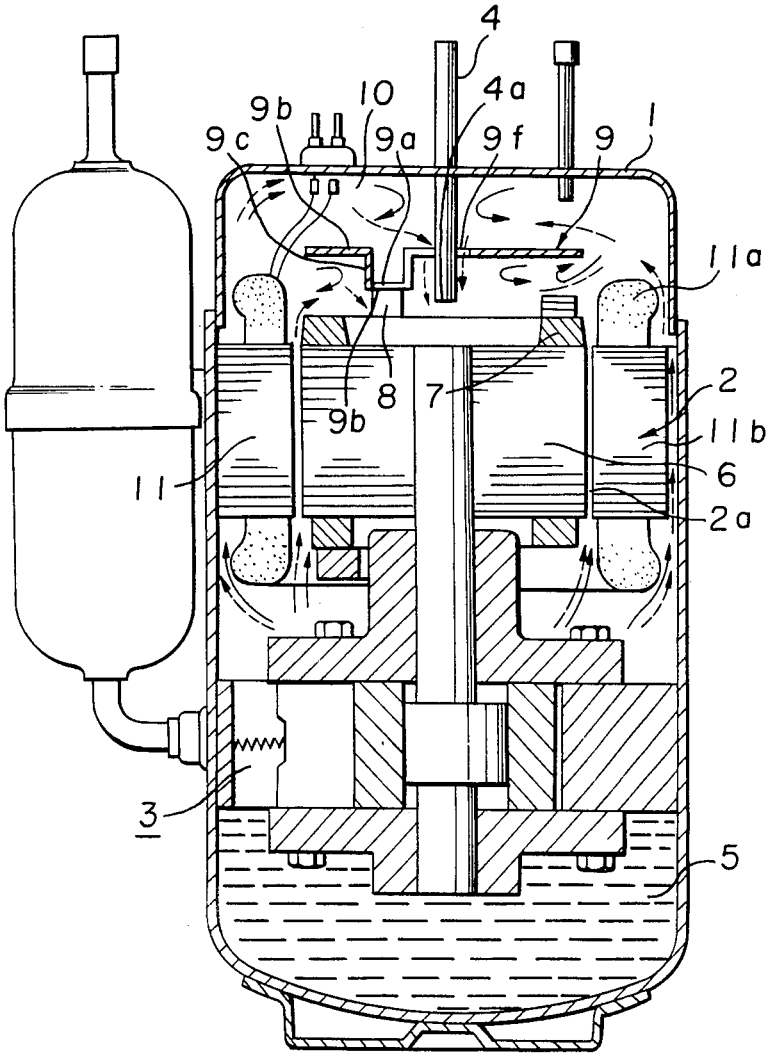
FIG. 1 is a longitudinal cross-sectional view of an embodiment of the rotary compressor according to the present invention.
Figure 2:
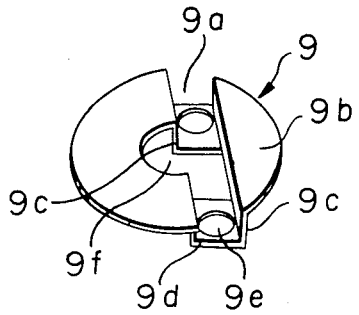
FIG. 2 is an enlarged perspective view of a circular plate according to an embodiment of the present invention.
Figure 3:
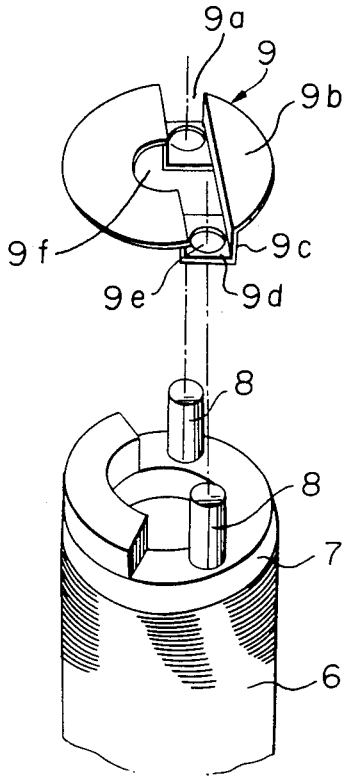
FIG. 3 is an exploded perspective view of an oil separating means in which the circular plate shown in FIG. 2 is used.
Figure 7:
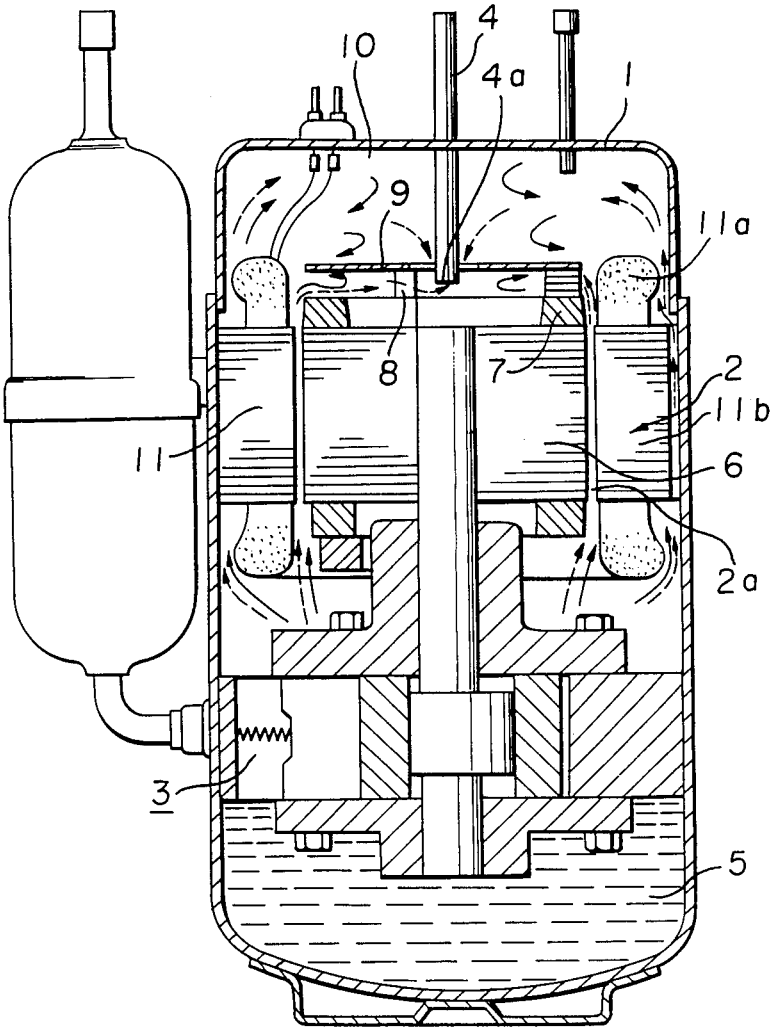
FIGURE 7 PRIOR ART
FIG. 7 is a longitudinal cross-sectional view of a conventional rotary compressor.

FIGS. 1 to 3 show a first embodiment of the rotary compressor according to the present invention in which the same reference numerals as in FIGS. 7 and 8 designate the same or corresponding parts.

A circular plate 9 is provided with a channel-like recess 9*a* at a position deviated from the central portion. The channel-like recess may be formed by bending a part of the flat portion 9*b* of the circular plate downwardly, i.e. in the direction of the rotor 6 in parallel to the line of the diameter of the plate 9. The cross-section of the channel-like recess 9*a* is square or rectangular so that the lower surface of the recess 9*a* is flat. Thus, the recess 9*a* has a side portion 9*c* which extends in parallel to the axial line of the rotor 6. The lower surface 9*d* formed in parallel to the flat portion 9*b* is provided with a pair of apertures 9*e* i.e. fixing parts. The circular plate 9 is firmly attached to the upper surface of the rotor 6 of the motor element 2 through the end ring 7 by a pair of caulking pins 8 which are inserted in the apertures 9*e* and connected thereto by caulking.

The circular plate 9 has the outer diameter substantially equal to the outer diameter of the rotor 6 and a central aperture in which a part of the recess 9*a* is included. The discharge tube 4 extends passing through the top of the sealing case 1 in alignment with the axial line of the rotor and the lower part of the discharge tube 4 is inserted in the aperture 9*f* with a gap between the outer periphery of the tube 4 and the inner circle of the aperture 9*f*.

In the rotary compressor having the construction as above-mentioned, the lubricating oil is entrained in the highly pressurized refrigerant gas compressed in the compression element 3 and the oil-gas mixture is introduced into the upper space 10 of the sealing case 1 through gaps in the motor element 2. The lubricating oil deposits on the front and reverse surfaces of the flat portion 9*b* of the circular plate which is rotated along with the rotor 6. The lubricating oil having a larger specific gravity is separated from the highly compressed gas and is splashed in the outer circumferencial direction of the circular plate 9 due to the centrifugal force. At the same time, the side portion 9*c* of the channel-like recess 9*a* of the circular plate 9 which is in parallel with the axial line of the rotor 6 acts as if it is a blade downwardly extending from the circular plate 9 when the rotor 6 revolves, whereby the side portion 9*c* of the recess 9*a* agitates the highly pressurized gas including the lubricating oil in the space defined by the rotor 6 and the flat portion 9*b* of the circular plate 9 to thereby accelerate separation of the lubricating oil from the refrigerant gas.

Figure 5:
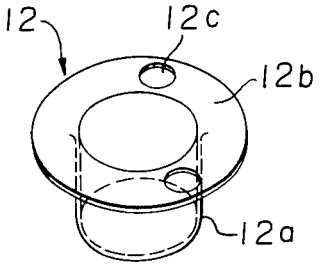
FIG. 5 is an enlarged perspective view of an embodiment of the lower circular plate used for the rotary compressor shown in FIG. 4.
Figure 4:
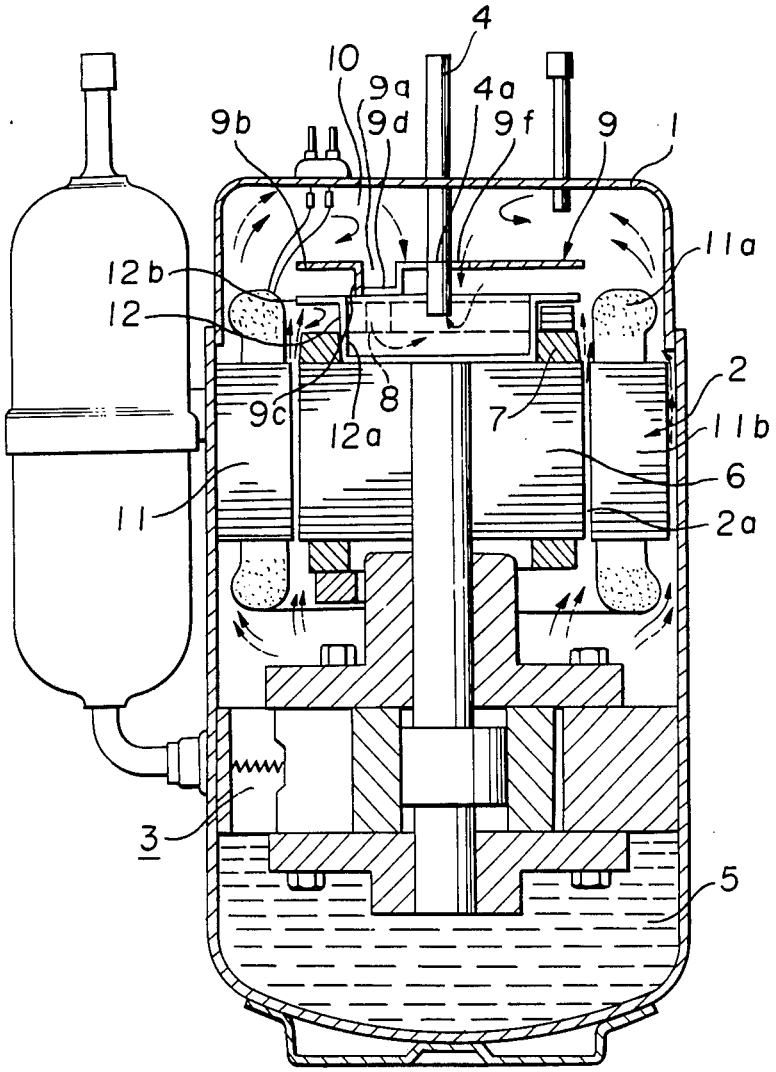
FIG. 4 is a longitudinal cross-sectional view of another embodiment of the rotary compressor according to the present invention.
Figure 6:
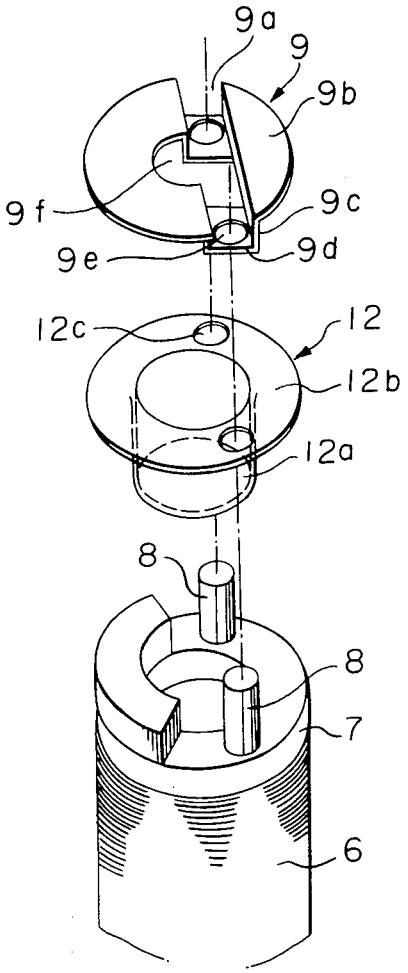
FIG. 6 is an exploded perspective view of an oil separating means in which the circular plate and the lower circular plate of the present invention are used.

FIGS. 4 to 6 show another embodiment of the present invention in which the same reference numerals as in FIGS. 1 to 3 designate the same or corresponding parts.

A reference numeral 12 designates a lower circular plate constituting the oil separating means in association with the circular plate 9 having the recess 9*a*. The lower circular plate 12 has a cylindrical portion 12*a* whose axial line is along the axial line of the rotor 6 and a flange portion 12*b* having the outer diameter substantially equal to the outer diameter of the rotor 6. The flange portion 12*b* is provided at the upper end of the cylindrical portion 12*a*. A pair of openings 12*c* are formed in the flange portion 12*b*. The lower circular plate 12 is arranged on the rotor 6 so that the axial line of the cylindrical portion 12*a* is in alignment with the axial line of the rotor 6. The circular plate 9 is put on the lower circular plate 12 so that the apertures 9*e* formed in the lower surface 9*d* of the recess 9*a* are superimposed on the openings 12*c* formed in the flange portion 12*b*. The caulking pins 8 each one end being connected to the upper surface of the rotor 6 through the end ring 7 are inserted in the openings 12*c* and the apertures 9*e* so as to connect them by caulking. Thus, the circular plate 9 and the lower circular plate 12 are fixed to the rotor 6.

Thus, in the second embodiment of the present invention, a lower circular plate 12 having the cylindrical portion 12*a* is placed between the rotor 6 and the circular plate 9 having the recess 9*a*, and the flange portion 12*b* of the lower circular plate 12 is placed between the end ring 7 and the flat portion 9*b* of the circular plate 9. The lower end of the discharge tube 4 opens in the cylindrical portion 12*a* of the lower circular plate 12. Accordingly, the cylindrical portion 12*a* restricts an opening for introducing the highly pressurized refregerant gas including the lubricating oil entering from the outer circumferential portion of the rotor 6. It provides the same effect as that the height of the end ring 7 is increased. With the construction, the lubricating oil is splashed in the outer circumferential direction in the space defined by the flat portion 9*b*, the recess 9*a* of the circular plate 9 and the flange portion 12*b* of the lower circular plate 12 so that effect of separating the lubricating oil is further increased. Accordingly, in the above-mentioned embodiments of the rotary compressor of the present invention, the highly compressed refrigerant gas without containing the lubricating oil is filled around the opening 4*a* of the lower end of the discharge tube 4. In particular, according to the second embodiment, the function of separating oil can be stably obtained regardless of the relative dimension in height of structural elements such as the end ring 7, the coil end 11*a* of the motor element 2.

Thus, according to the present invention, the channel-like recess projecting toward the rotor of the motor elememt is formed in the circular plate which is rotated along with the rotor. Accordingly, a remarkable effect of separation of the lubricating oil contained in the highly compressed gas is improved while the construction of the oil separating means is simple. The oil separating means prevents escape of the lubricating oil when the rotary compressor is operated with an excessively large amount of the refrigerant. It provides effective function of separating of the oil regardless of relative dimension in height of the spactural elements of the motor. It is especially suitable for compression of the refrigerant gas without containing the lubricating oil.

We claim:

1. A rotary compressor comprising a sealing case, a motor element housed in the upper part of said sealing case, a compression element housed in the lower part of said sealing case so as to be driven by said motor element, a discharge tube provided at the top of said sealing container so that compressed gas filled in the upper part of said sealing case is discharged out of the same and an oil separating means mounted on the rotor of said motor element, characterized in that said oil separating means has a circular plate having a diameter substantially equal to the outer diameter of said rotor, wherein a channel-like recess projecting toward said rotor is formed in said circular plate at a position deviated from its central portion; the lower surface of the channel-like recess is adapted to be firmly connected to the upper surface of said rotor, and an aperture is formed at the central portion so that said discharge tube is loosely inserted in the aperture.

2. The rotary compressor according to claim 1, wherein said channel-like recess is formed by bending a portion of said circular plate.

3. The rotary compressor according to claim 1, wherein the cross-section of said channel-like recess is square or rectangular so as to have a flat lower surface.

4. The rotary compressor according to claim 1, wherein said oil separating means has a lower member which is placed between said circular plate and said rotor and which comprises a cylindrical portion which is fixed to said rotor and has its axial line extending along the axial line of said rotor, and a flange portion having a diameter substantially equal to the outer diameter of said rotor, said flange portion being provided at the upper end of said cylindrical portion.

* * * * *